US005828176A

United States Patent [19]

Goebel

[11] Patent Number: 5,828,176

[45] Date of Patent: Oct. 27, 1998

[54] PLANAR CROSSED-FIELD PLASMA SWITCH AND METHOD

[75] Inventor: Dan M. Goebel, Tarzana, Calif.

[73] Assignee: Hughes Electronics Corporation, El Segundo, Calif.

[21] Appl. No.: 753,617

[22] Filed: Nov. 27, 1996

[51] Int. Cl.[6] ..... H01J 7/24

[52] U.S. Cl. ..... 315/111.41; 315/111.21; 315/340; 315/344; 313/156; 313/157

[58] Field of Search ..... 315/344, 348, 315/111.41, 111.21, 338, 340; 313/156–159, 161, 162, 284, 289, 231.41; 361/2, 3, 5–7

[56] References Cited

U.S. PATENT DOCUMENTS

| | | | |
|---|---|---|---|
| 4,247,804 | 1/1981 | Harvey et al. | 315/344 |
| 4,596,945 | 6/1986 | Schumacher et al. | 315/344 |
| 5,019,752 | 5/1991 | Schumacher | 315/344 |
| 5,329,205 | 7/1994 | Goebel et al. | 315/111.21 |
| 5,336,975 | 8/1994 | Goebel et al. | 315/111.41 |
| 5,608,297 | 3/1997 | Goebel | 315/344 |

OTHER PUBLICATIONS

U.S. application No. 08/364,357 filed Dec. 27, 1994 Goebel, Dan M.

Graf, Rudolf F., Modern Dictionary of Electronics, MacMillan Computer Publishing, Carmel, Indiana, sixth edition, pp. 1038, 1039.

*Primary Examiner*—Robert J. Pascal
*Assistant Examiner*—Haissa Philogene
*Attorney, Agent, or Firm*—V. D. Duraiswamy; W. K. Denson-Low

[57] ABSTRACT

A cold-cathode, crossed field switch has a magnet system which generates a magnetic field that is radially-oriented about a switch axis and a planar electrode system which generates an axially-oriented electric field. These structures facilitate a switch whose capacitance, inductance and fabrication costs are all reduced from that of conventional cold-cathode, crossed-field switches. Magnets of the magnet system are arranged in two concentric annular rings with their north and south poles aligned either axially or radially. The planar electrode system includes a cathode, a source grid, a control grid and an anode which are arranged in a substantially parallel relationship.

20 Claims, 4 Drawing Sheets

PLANAR CROSSED-FIELD PLASMA SWITCH AND METHOD

BACKGROUND OF THE INVENTION

1. Field of the Invention

The present invention relates generally to high-current switches and more particularly to crossed-field plasma switches.

2. Description of the Related Art

As described in standard electronics references (e.g., Graf, Rudolph F., *Modern Dictionary of Electronics,* Macmillan Computer Publishing, Carmel, Ind., Sixth Edition, pp. 1038–1039) a conventional thyratron is a current switch. It has a control grid positioned between a thermionic cathode and an anode and these electrodes are arranged in a planar relationship in a tube which is filled with a high-pressure gas. A positive pulse on the grid ionizes the gas and initiates current flow between the cathode and anode. Thyratrons can carry high peak currents (e.g., 20 kA) but grid signals have no effect after current flow is initiated. The current can only be interrupted by lowering the anode voltage or by reducing the current with external means.

The planar electrodes of thyratrons facilitate simple fabrication processes (e.g., the electrodes are arranged in a stacked relationship and joined together in a single brazing operation). As a consequence, they are generally less expensive than other high-current switches. However, their pulse repetition rate is typically limited to 1–2 kHz. In addition, their thermionic cathodes require additional power supplies and reduce the switch lifetime.

In contrast to thyratrons, a CROSSATRON Modulator Switch (CMS) (CROSSATRON is a trademark of Hughes Electronics, El Segundo, Calif.) includes a cold cathode, a low-pressure gas (e.g., hydrogen at a pressure of ~0.16 Torr) and a control grid which has full control of the switch. FIG. 1 illustrates an exemplary CMS 20. Coaxially arranged about a cylindrical cathode 22 is an axially-periodic magnet ring 24 which generates an axial magnetic field B within the cathode. Coaxially arranged within the cathode 22 is a cylindrical source grid 26. A positive voltage on the source grid 26 establishes a radial electric field E between the source grid and the cathode. Low-pressure gas is provided by a gas reservoir 27.

In operation of this portion of the CMS 20, stray gas electrons are directed in cycloidal paths by the orthogonal (crossed) magnetic and electric fields. These long paths near the surface of the cathode enhance the collision rate with neutral gas and, therefore, the production of secondary electrons and ions. The structure of the magnet ring 24, cathode 22 and source grid 26 thereby generates a low-density plasma source in an annular source grid-to-cathode gap 28.

Coaxially arranged within the source grid is a cylindrical anode 30 and coaxially positioned between the anode and the source grid is a cylindrical control grid 32. Because large voltages typically exist between the cathode 22 and the anode 30, the switch must be carefully designed to prevent arcing and Paschen breakdown. Resistance to arcing is enhanced by increasing the spacing between the cathode 22 and the anode 30 but resistance to Paschen breakdown is enhanced by reducing this spacing and by reducing the gas pressure.

These conflicting needs are addressed with an annular Paschen shield 38 which extends upward from the cathode 22. The Paschen shield 38 surrounds the upper portion of the anode 30 and reduces the spacing between the cathode and the anode to avoid Paschen breakdown. In addition, adjacent surfaces of the Paschen shield 38 and the anode 30 are curved and spaced (e.g., by ~1 centimeter) to avoid arcing.

The anode 30 is coupled to the remaining structure with a dielectric support 40 which is fabricated, for example, from a ceramic. Electrical access to the cathode 22, the source grid 26 and the control grid 32 is provided by a group 42 of connectors 44 and electrical access to the anode 30 is provided by an annular connector 48.

In its operation, the CMS 20 is typically embedded in a circuit for the purpose of controlling current pulses. As long as the potential on the control grid 32 is in the region of the cathode's potential, no current flows through the switch 20 and the circuit voltage is sustained across an annular control grid-to-anode gap 49. When the potential of the control grid 32 is raised sufficiently above the cathode potential, a plasma path is established across the control grid-to-anode gap 49. This plasma path joins with the plasma source to complete a current path between the cathode 22 and the anode 30. The current is carried by electrons and ions which flow in opposite radial directions in a plasma-interaction region 50. The plasma source is maintained by secondary electrons which are generated when the ions strike the cold cathode 22. The switch current is interrupted when the control grid potential is returned to that of the plasma source.

CMS switches have been disclosed in a series of patents assigned to Hughes Electronics, the assignee of the present invention. These include U.S. Pat. No. 4,247,804 issued Jan. 27, 1981 to Robin J. Harvey, U.S. Pat. No. 4,596,945 issued Jun. 24, 1986 to Robert W. Schumacher, et al., U.S. Pat. No. 5,329,205 issued Jul. 12, 1994 to Dan M. Goebel, et al., U.S. Pat. No. 5,336,975 issued Aug. 9, 1994 to Dan M. Goebel, et al. and copending U.S. patent application Ser. No. 08/364,357 which was filed Dec. 27, 1994 in the name of Dan M. Goebel, now U.S. Pat. No. 5,608,297.

These cold cathode, crossed field switches have long lifetimes, can switch high peak currents (e.g., 10 kA) at high repetition rates (e.g., 10 kHz) and withstand high voltages (e.g., 120 kV). Their large, cylindrical cathode surfaces facilitate the realization of high secondary-electron currents and also form a natural shield for X-rays that are generated during switching transients. However, the large cathode surface also produces a large cathode-to-anode capacitance in the plasma-interaction region 50 which is increased by the capacitance between the Paschen shield and the anode in a shield region 52. Also, a large inductance results from the long anode geometry that is required to extend through the shield region 52 and reach the plasma-interaction region 50. Switch capacitance forms a voltage divider with external circuit capacitance and a large switch capacitance reduces energy transfer through the switch. The large inductance reduces current change rate (di/dt) which limits repetition rate.

Although the concentric electrodes of these switches inherently produce a thermally stable switch structure, they are difficult to fabricate and their concentricity specifications typically require multiple assembly steps and expensive alignment tooling.

SUMMARY OF THE INVENTION

The present invention is directed to cold cathode, crossed-field switches with enhanced switch repetition rates and energy transfer and reduced fabrication costs. The switches are especially suited for applications (e.g., lasers and microwave sources) which require short-pulse, high-repetition-rate generators.

These goals are realized with a magnet system that generates a radial magnetic field and a planar electrode structure that generates an axial electric field. In the planar electrode structure, a source grid is spaced from a cathode to generate the electric field and to form a source grid-to-cathode gap that substantially contains the crossed magnetic and electric fields. These fields direct secondary ions from the cathode along cycloidal paths in an ionizable gas to generate a plasma source in the source grid-to-cathode gap.

The planar electrode structure has a control grid positioned between the plasma source and an anode and spaces these electrodes to form a control grid-to-anode gap. First and second voltages selectively applied to the control grid form and remove an electrostatic shield between the plasma source and the anode. Removing this shield opens a plasma path across the control grid-to-anode gap which couples with the plasma source to form a current path between the cathode and the anode.

The planar electrode structure has less capacitance and inductance than conventional (i.e., cylindrical) cold cathode, crossed-field switches and is therefore faster than these switches. In addition, the planar electrode structure removes the need for a Paschen shield structure and facilitates less expensive assembly processes (e.g., stacked electrodes which are brazed in a single operation).

In one magnet system embodiment, a plurality of magnets are arranged in concentric rings and the north and south poles of the magnets are aligned axially. In another magnet system embodiment, the magnets of the concentric rings have their north and south poles aligned radially.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 2:
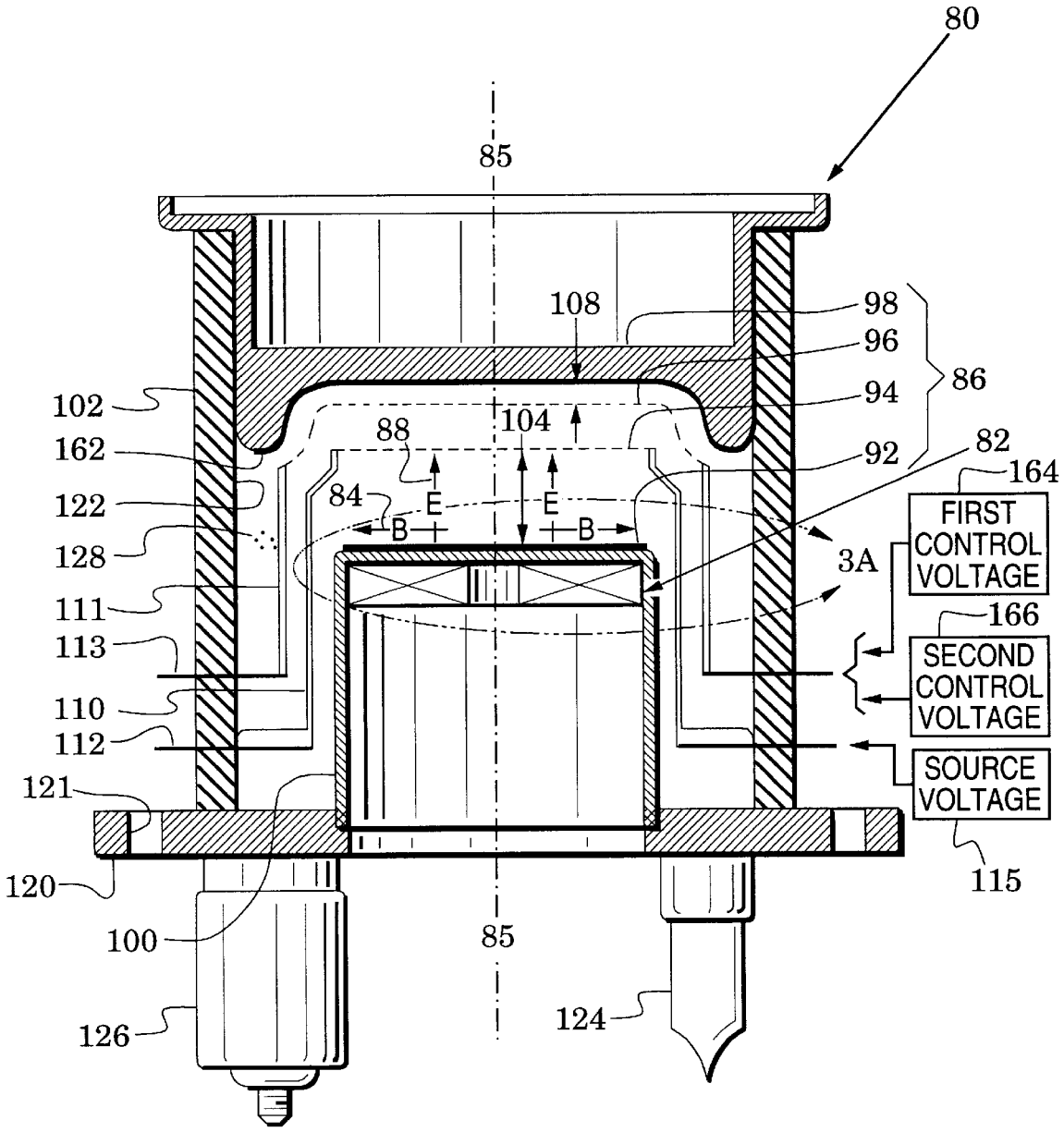
FIG. 2 is a sectional view of a cold-cathode, crossed-field switch in accordance with the present invention.

FIG. 2 illustrates a high-current switch 80. The switch includes a magnet system 82 which generates a magnetic field 84 that is radially-oriented about a switch axis 85 and a planar electrode system 86 which generates an axially-oriented electric field 88. These structures facilitate a switch whose capacitance and inductance are reduced from that of conventional cold-cathode, crossed-field switches. Accordingly, the switch 80 is particularly suited for high-repetition-rate, short-pulse applications. In addition, the planar electrode system 88 is relatively inexpensive to fabricate and assemble.

In particular, the planar electrode system 86 includes a cathode 92, a source grid 94, a control grid 96 and an anode 98. The cathode 92 and the magnet system 82 are respectively positioned on upper and lower surfaces of a magnet holder 100. The anode 98 is supported above the cathode 92 by a cylindrical dielectric support 102. The source grid 94 is positioned between the anode 98 and the cathode 92 and is spaced from the cathode to form a source grid-to-cathode gap 104 which substantially contains the radially-oriented magnetic field 84.

The control grid 96 is positioned between the anode 98 and the source grid 94 and is spaced from the anode to form a control grid-to-anode gap 108. The source grid 94 and the control grid 96 are respectively carried on annular support members 110 and 111 which, in turn, are coupled to annular electrical connectors 112 and 113 that extend through the dielectric support 102.

A source voltage 115 coupled to the source grid 94 generates the electric field 88 between it and the cathode 92. Because these electrodes are generally planar and parallel and orthogonal to the switch axis 85, the electric field is axially oriented across the source grid-to-cathode gap 104.

The magnet holder 100 and the dielectric support 102 are carried on a base 120 which provides electrical access to the cathode 92. The base 120 has through holes 121 for mounting the switch. A cavity 122 is formed by the magnet holder 100, the dielectric support 102 and the anode 98. A pump-out tube 124 and a gas reservoir 126 communicate with the cavity 122 through the base 120. The gas reservoir 126 contains metals, e.g., zirconium and aluminum, that are saturated with a gas 128, e.g., hydrogen. The pump-out tube 124 facilitates evacuation of the cavity 122 to a near vacuum. After evacuation, the gas reservoir 128 fills the cavity 122 with a low-pressure gas.

Figure 3B:
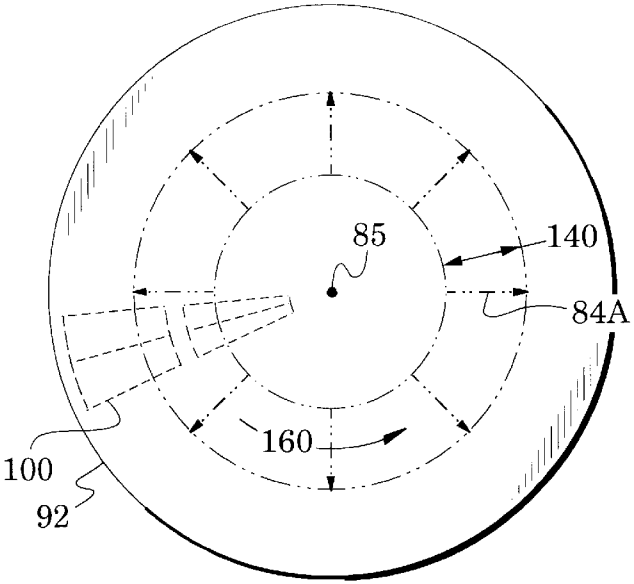
FIG. 3B is a plan view of the cathode and magnet system of FIG. 3A which shows a radially-oriented magnetic field that is generated by the magnet system.
Figure 3A:
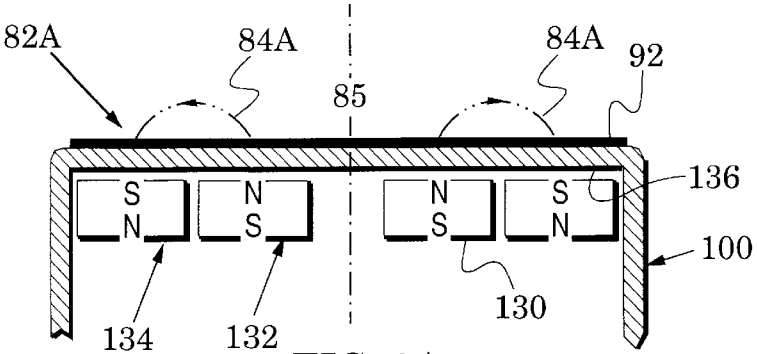
FIG. 3A illustrates an embodiment of a cathode and a magnet system within the curved line 3A of FIG. 2.

To facilitate an operational description of the switch 80, attention is first directed to FIGS. 3A and 3B which illustrate an embodiment 82A of the magnet system 82. In this embodiment, a plurality of magnets 130 are arranged in two concentric annular rings 132 and 134 beneath the floor 136 of the magnet holder 100. The north and south poles of these magnets are aligned axially with respect to the switch axis 85. In general, north poles in the inner ring 132 face in one axial direction and the poles in the outer ring 134 face in an opposite axial direction. In FIG. 3A, these directions are chosen such that the north poles in the inner ring 132 face the cathode 92.

In the region above the cathode 92, flux lines 84A of the magnetic field flow radially outward from the inner ring 132 to the outer ring 134. Similar flux lines flow between the rings in the region below the magnet holder 100 but these are not shown because they serve no functional role. The magnetic field has an axis which is substantially coaxial with the switch axis 85. For clarity of illustration, only exemplary ones of the magnets 130 are shown in FIG. 3B.

In response to the radial magnetic field 84A and the axial electric field (88 in FIG. 2), electrons in the source grid-to-cathode gap (104 in FIG. 2) are directed in cycloidal paths having the circumferential direction 160 of FIG. 3B. This circumferential direction is reversed if the orientation of the north and south poles of the magnets 130 is reversed.

Although the magnet system 82A forms a radially-oriented magnetic field, the radial width 140 (shown in FIG.

Figure 4B:
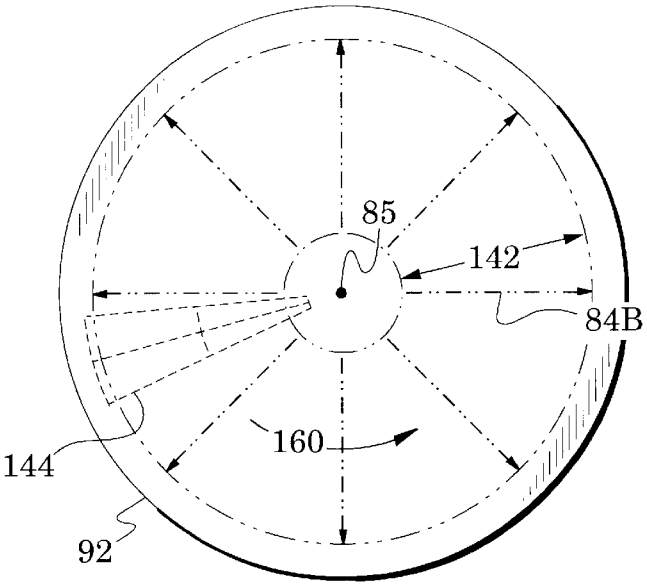
FIG. 4B is a plan view of the cathode and magnet system of FIG. 4A which shows a radially-oriented magnetic field generated by the magnet system.
Figure 4A:
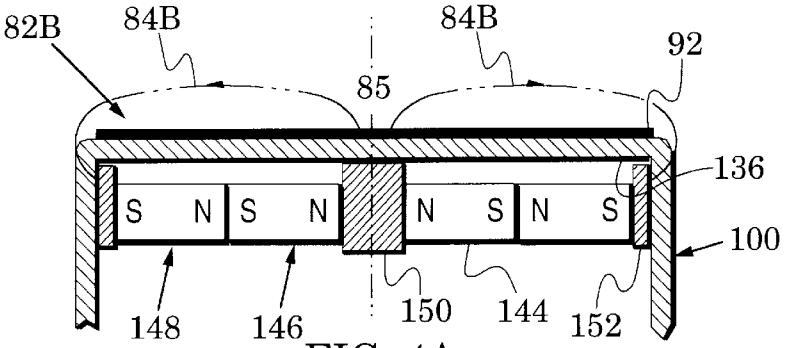
FIG. 4A is a view similar to FIG. 3A which illustrates another cathode and magnet system embodiment.

3A) of the field in the region of the source grid-to-cathode gap (104 in FIG. 2) is somewhat limited. A magnetic field with a greater radial field width 142 is generated by the magnet system 82B of FIGS. 4A and 4B. In this magnet system embodiment, a plurality of magnets 144 are also arranged in two concentric annular rings 146 and 148 but the north and south poles are aligned radially. The north poles in both concentric rings face in the same radial direction which, in FIG. 4A, is chosen to be inward.

A pole piece 150 is positioned on the switch axis 85 and a second annular pole piece 152 surrounds the outer magnet ring 148. The pole pieces are formed of a material, e.g., iron, which enhances magnetic flux density. In the region above the cathode 92, flux lines 84B flow radially outward between the inner pole piece 150 and the outer pole piece 152. The configuration of the magnet system 82B generates a radial field width 142 in the source grid-to-cathode gap (104 in FIG. 2) that is greater than the radial field width (140 in FIG. 3A) of the magnet system 84A. Accordingly, electrons in the source grid-to-cathode gap (104 in FIG. 2) will be directed along the circumferential direction 160 over a wider radial range. For clarity of illustration, only exemplary ones of the magnets 144 are shown in FIG. 4B.

Attention is now directed to operation of the switch 80 of FIG. 2. The axial electric field 88 in the source grid-to-cathode gap 104 is generated by applying a source voltage 115 to the source grid 94 that is positive relative to the cathode 92. The crossed magnetic and electric fields 84 and 88 direct stray electrons of the low-pressure gas 128 along cycloidal paths in the source grid-to-cathode gap 104. These paths are indicated in FIGS. 3B and 4B by the rotation direction arrows 160 (this rotation direction will be reversed if the north and south pole orientation of the magnet systems 82A and 82B of FIGS. 3A and 3B is reversed).

The length of these cycloidal electron paths enhances the electron collision rate with molecules of the gas 128. The consequent generation of secondary electrons and ions forms a low-density plasma source. The configuration of the magnet system 82 causes the crossed fields to be substantially enclosed by the source grid-to-cathode gap 104. Consequently, the low-density plasma source is substantially restricted to the source grid-to-cathode gap and does not extend appreciably into the control grid-to-anode gap 108.

The switch 80 is placed in its open and closed modes by application of first and second control voltages 164 and 166 to the control grid 96. The first control voltage 164 is negative relative to the potential of the plasma and forms an electrostatic shield that blocks the flow of electrons to the anode 98. In particular, this negative voltage repels electrons of the plasma and forms an ion sheath about the control grid 96.

The second control voltage 166 is positive relative to the potential of the plasma. When it is applied, electrons flow through the control grid 96 to the anode 98 and ions flow to the cathode 92. Essentially, a plasma path is formed across the control grid-to-anode gap 108 and this plasma path is joined with the plasma source in the source grid-to-cathode gap 104 to form a current path between the cathode 92 and the anode 98.

Figure 1:
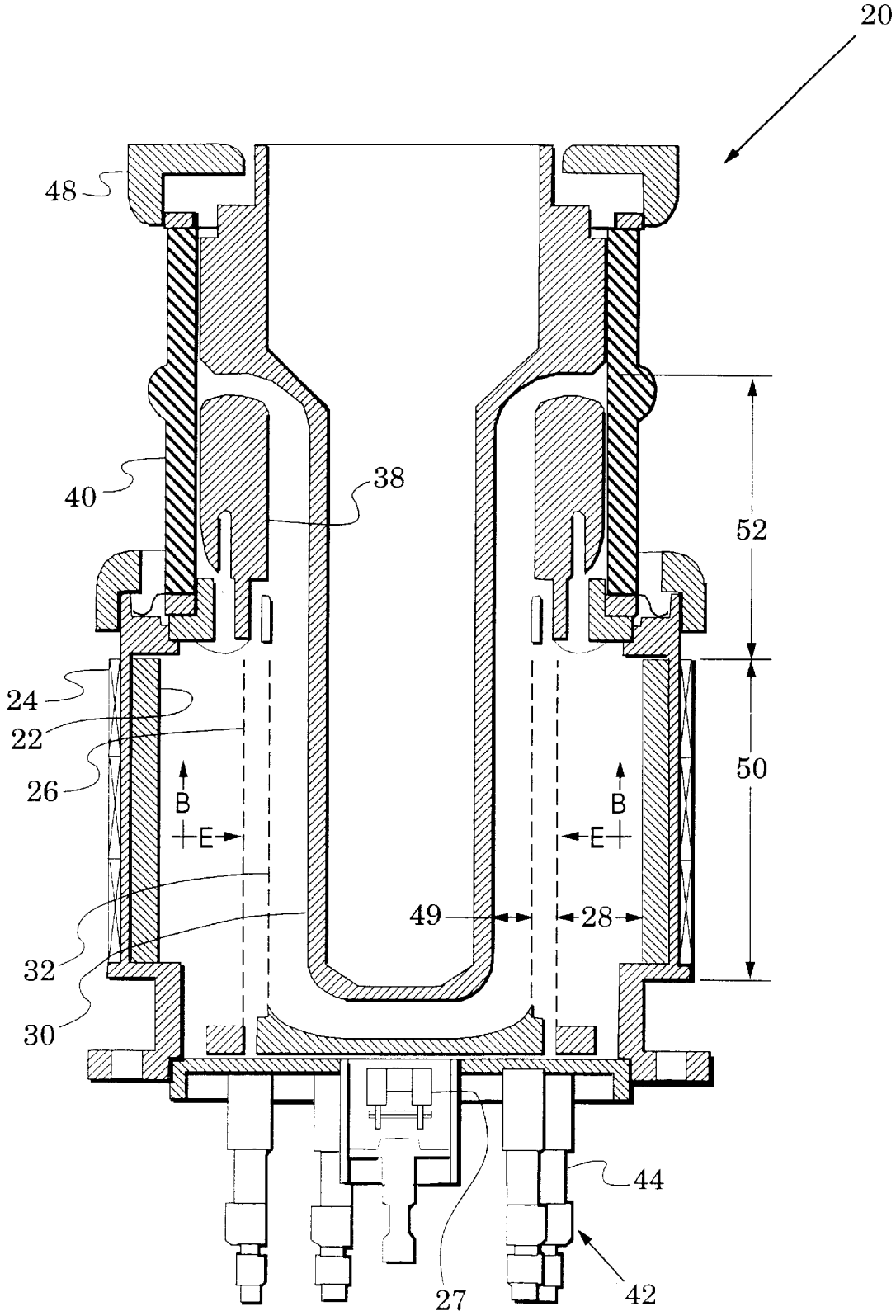
FIG. 1 (PRIOR ART)
FIG. 1 is a sectional view of a conventional cold-cathode, crossed-field switch.

To reduce the possibility of arcing between the switch 80 and elements of a circuit in which the switch is embedded, the source grid 94 and control grid 96 are preferably positioned in the middle region of the dielectric support 102 and their electrical connectors 112 and 113 are positioned in the lower region of the switch (to prevent breakdown between the anode 98 and the control grid 96 in the air region external to the dielectric support 102). The planar electrode structure 86 facilitates these arrangements. The planar arrangement of cathode and anode also inherently reduces the possibility of Paschen breakdown so that a complex shield structure (e.g., the annular Paschen shield 38 of FIG. 1) is not required.

To reduce sputtering of gas impurities onto the inner surface of the dielectric support 102, the generally planar anode 98 includes an annular portion 162 which extends into the cavity 122. This annular portion serves as a line-of-sight sputter shield between the grids and the dielectric support 102. The control grid 96 is preferably shaped to maintain a constant spacing between it and the annular anode portion 162.

In the on mode of the switch, the plasma density greatly increases in the cavity 122. To realize high repetition rates, this high-density plasma must be rapidly deionized in the switch's off mode. Because the planar switch 80 has less volume between its cathode and anode, it accomplishes deionization faster than the cylindrical switch 20 of FIG. 1. Accordingly, it is capable of much higher repetition rates (e.g.,>>10 kHz). On the other hand, peak switch current is enhanced with greater cavity volume so that the switch 80 does not have the peak current capability of the switch 20.

There is a trade off in the spacing of the cathode 92 from the anode 98. Spacing it closer to the anode reduces the cavity volume so that repetition rate is increased but the current rating is decreased. In the switch 80, the magnet holder 100 is elongated to raise the cathode 92 closer to the anode 98 and enhance the repetition rate.

Figure 5:
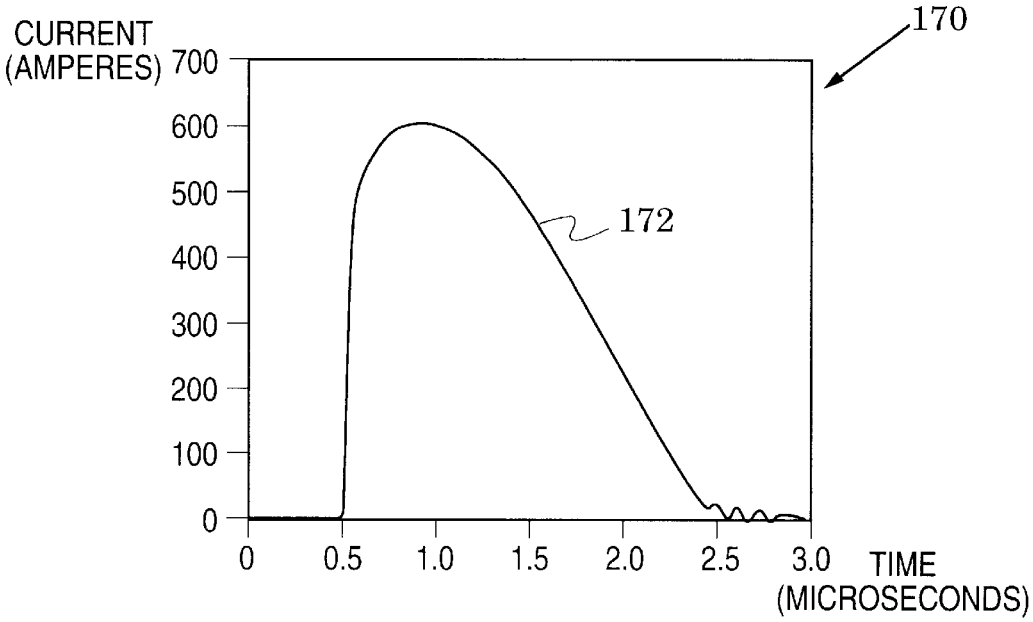
FIG. 5 is a diagram of a current pulse obtained with a prototype of the switch of FIG. 2.

An exemplary prototype of the switch 80 was fabricated and tested. In the prototype switch, the dielectric support 102 was ~10 centimeters in diameter and formed of ceramic. The cavity 122 was filled with hydrogen at ~0.16 Torr of pressure. FIG. 5 is a graph 170 which shows a pulse 172 that was obtained with the prototype. The pulse 172 has an amplitude of ~600 amperes and a duration of ~2 microseconds. In its off mode, the switch sustained ~5.2 kV. The pulse 172 demonstrates the fast closing time characteristic of cold cathode, crossed-field switches and the fast opening time achievable with the planar configuration of the switch 80.

In another prototype test, current pulse trains were generated having a repetition rate >30 kilohertz and peak currents >200 amperes with an off mode voltage of >30 kilovolts. In still another prototype test, current pulse trains were generated having a pulse width of ~50 nanoseconds and a repetition rate >30 kilohertz. This latter performance was limited by the available grid drive circuits. These repetition rates are greater than those of conventional cold-cathode, crossed-field switches and much greater than those of conventional thyratrons. The prototype also demonstrated that planar switches of the invention are smaller (e.g., a length which is ½ to ⅓ of previous lengths) than conventional cold-cathode, crossed-field switches. The prototype's cathode was fabricated with a flat upper surface. If desired, the switches of the invention can have their peak currents enhanced by increasing this cathode surface with a plurality of corrugations.

Figure 6:
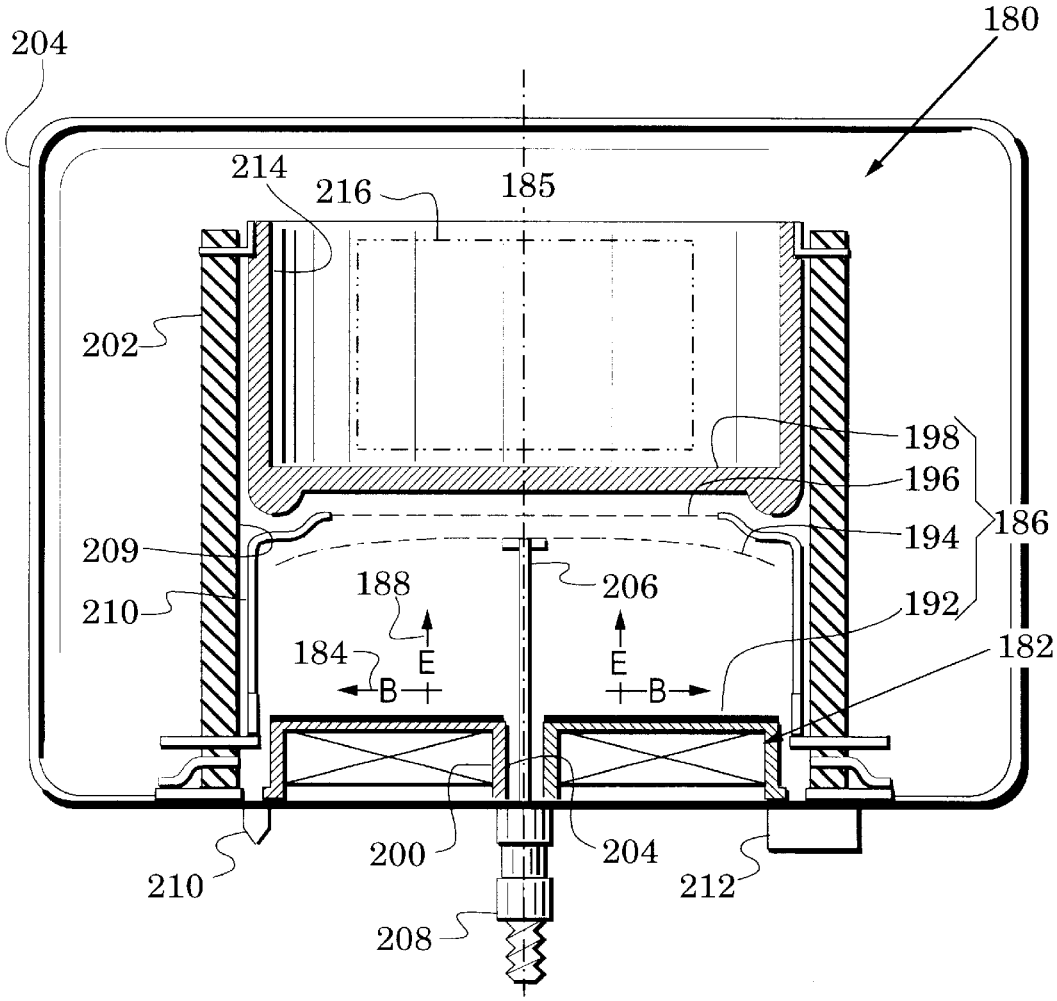
FIG. 6 is a sectional view of another cold cathode, crossed field switch in accordance with the present invention.

Another planar switch embodiment 180 is shown in FIG. 6. Similar to the switch 80, the switch 180 has a magnet system 182 that generates a radial magnetic field 184 about a switch axis 185 and a planar electrode system 186 which generates an axial electric field 188.

The planar electrode system 186 includes a cathode 192, a source grid 194, a control grid 196 and an anode 198. The cathode 192 and the magnet system 182 are respectively positioned on upper and lower surfaces of a magnet holder 200. The anode 198 is supported above the cathode 92 by a cylindrical dielectric support 202.

As in the switch 80 of FIG. 2, the electrodes of the electrode system 186 are generally planar and parallel. In contrast to the switch 80, the magnet holder 200 and the cathode 192 form a central aperture 204 and the source grid 194 is positioned by a support member 206 which extends through the aperture 204 to a source grid connector 208. The control grid 196 is supported by an annular ring 210 that is carried by the dielectric support 202.

The magnet holder 200 and the dielectric support 202 are carried within a coaxial, cylindrical case 204 which forms a low-inductance return path for the switch 180. The case 204 also forms a container to hold a heat-conductive fluid or gas that conducts heat away from the switch. Although not shown, a sealed aperture is formed through the case 204 for passage of an anode connector. The magnet holder 200, the dielectric support 202 and the anode 198 form a cavity 209 and a pump-out tube 210 and a gas reservoir 212 communicate with the cavity 209 to respectively evacuate the cavity and fill it with a low-pressure gas.

The operational modes of the switch 180 are similar to those of the switch 80 of FIG. 2. However, the switch 180 has its cathode 192 spaced further from its anode 198 than in the case of the switch 80. Accordingly, its peak current will be enhanced with a consequent decrease in repetition rate capability.

Switches of the invention may be effectively used as high-repetition-rate, short-pulse switching elements with enhanced energy transfer from storage capacitors. To increase their speed in these applications, external circuit inductances are preferably minimized. Accordingly, a cup 214 formed in the upper portion of the anode 198 can hold an energy storage capacitor 216 for direct coupling to the anode.

In fabricating planar cold-cathode, crossed-field switches, preferred materials are molybdenum and chrome for cathodes and control grids, stainless steel for source grids, copper and stainless steel for anodes, stainless steel for grid supports, Kovar for grid electrical connectors and samarium cobalt for magnets. Processes for forming grid apertures include punching and photoetching.

Switches of the present invention are especially suited for high-repetition-rate, short-pulse applications. Their radially-oriented magnetic fields and axially-oriented electric fields allow them to be smaller and less expensive and have less capacitance and inductance than conventional cold-cathode, crossed-field switches. In addition, their planar electrodes can be assembled in a stacked relationship and joined together in a single brazing operation (performed, for example, in a hydrogen furnace) to reduce fabrication costs. In contrast to thyratrons, these switches have far greater switch repetition rate capability and do not require thermionic cathodes with their attendant structures (e.g., heaters and current sources) and short lifetimes.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A cold cathode, crossed field switch arranged about a switch axis and containing an ionizable gas, comprising:

a magnet system configured to generate a magnetic field which surrounds said switch axis and is radially oriented outward from said switch axis; and a planar electrode system which includes:

a) a planar cold cathode;

b) a planar anode spaced from said cathode;

c) a planar source grid positioned between said anode and said cathode and spaced from said cathode to form a source grid-to-cathode gap which substantially contains said radially-oriented magnetic field, said source grid and said cathode arranged to generate an axially-oriented electric field in said source grid-to-cathode gap in response to a source voltage applied to said source grid, said radially-oriented magnetic field and said axially-oriented electric field directing secondary ions from said cathode along cycloidal paths in said ionizable gas to generate a plasma source in said source grid-to-cathode gap; and d) a planar control grid positioned between said anode and said source grid, and spaced from said anode to form a control grid-to-anode gap, said control grid arranged to selectively receive first and second control voltages to initiate and terminate a plasma path which connects said plasma source and said anode across said control grid-to-anode gap.

2. The switch of claim 1, wherein said magnet system includes a plurality of magnets arranged in coplanar and concentric rings.

3. The switch of claim 2, wherein said magnets are positioned so that said planar cathode is between them and said planar source grid.

4. The switch of claim 2, wherein said magnet system further includes first and second coplanar and concentric pole pieces with said magnets positioned between said first and second pole pieces.

5. The switch of claim 1, wherein said magnet system includes a plurality of magnets arranged in first and second coplanar and concentric rings, said magnets having their north and south poles aligned axially with the north poles in said first concentric ring facing in one axial direction and the north poles in said second concentric ring facing in an opposite axial direction.

6. The switch of claim 1, wherein said magnet system includes a plurality of magnets arranged in first and second coplanar and concentric rings, said magnets having their north and south poles radially aligned with the north poles in said first and second concentric rings facing in a common radial direction.

7. The switch of claim 1, wherein said cathode, said source grid, said control grid and said anode of said planar electrode system are in a parallel arrangement.

8. The switch of claim 1, further including:

a cylindrical dielectric member that supports said planar anode and contains said ionizable gas; and an annular shield member which extends from said anode into said control grid-to-anode gap to shield said dielectric member from sputtering impurities.

9. The switch of claim 1, wherein said magnet system includes a plurality of magnets arranged in first and second coplanar and concentric rings that are positioned so that said planar cathode is between them and said planar source grid and wherein said first and second rings, said cathode, said source grid, said control grid and said anode of said planar electrode system are in a parallel arrangement.

10. The switch of claim 1, further including:

a dielectric member which supports said anode;

a first support member carried by said dielectric member and connected to support said source grid; and a second support member carried by said dielectric member and connected to support said control grid.

11. The switch of claim 10, wherein said dielectric member and said first and second support members each have a cylindrical shape.

12. The switch of claim 1, wherein said cathode forms an aperture and further including:

a dielectric member which supports said anode;

a first support member extending through said aperture and connected to support said source grid; and a second support member carried by said dielectric member and connected to support said control grid.

13. The switch of claim 12, wherein said dielectric member and said second support member each have a cylindrical shape.

14. A method for providing a switchable current path through a plasma, comprising the steps of:

adjoining an ionizable gas with a cold cathode;

establishing a magnetic field in said ionizable gas so that, in at least a portion of said ionizable gas, said magnetic field surrounds a magnetic-field axis and is radially oriented outward from said axis;

establishing an electric field that is axially oriented in said ionizable gas portion along said magnetic-field axis so that said axially-oriented electric field and said radially-oriented magnetic field direct secondary electrons from said cathode along cycloidal paths in said ionizable gas portion to generate a plasma source; and selectively removing and forming an electrostatic shield between said plasma source and an anode to thereby initiate and terminate a plasma path between said plasma source and said anode, said plasma source and said plasma path forming said current path between said cathode and said anode.

15. The method of claim 14, wherein said magnetic field establishing step includes the step of generating said magnetic field with a plurality of magnets arranged in coplanar and concentric rings.

16. The method of claim 15, wherein said generating step includes the step of radially aligning north and south poles of said magnets.

17. The method of claim 15, wherein said generating step includes the step of axially aligning north and south poles of said magnets.

18. The method of claim 14, wherein said electric field establishing step includes the step of coupling a source voltage to a source grid which is spaced from said cathode.

19. The method of claim 14, wherein;

said forming step includes the step of coupling a first control voltage to a control grid which is spaced from said anode; and said removing step includes the step of coupling a second control voltage to said control grid.

20. A cold cathode, crossed field switch arranged about a switch axis and containing an ionizable gas, comprising:

a magnet system having magnets arranged in coplanar and concentric magnet rings about said switch axis to generate a magnetic field which surrounds said switch axis and is radially oriented outward from said switch axis;

a planar electrode system which includes:

a) a planar cold cathode;

b) a planar anode spaced from said cathode and positioned with said cathode between said anode and said magnet system;

c) a planar source grid positioned between said anode and said cathode and spaced from said cathode to form a source grid-to-cathode gap which substantially contains said radially-oriented magnetic field, said source grid and said cathode arranged to generate an axially-oriented electric field in said source grid-to-cathode gap in response to a source voltage applied to said source grid, said radially-oriented magnetic field and said axially-oriented electric field directing secondary ions from said cathode along cycloidal paths in said ionizable gas to generate a plasma source in said source grid-to-cathode gap; and d) a planar control grid positioned between said anode and said source grid, and spaced from said anode to form a control grid-to-anode gap, said control grid arranged to selectively receive first and second control voltages to initiate and terminate a plasma path which connects said plasma source and said anode across said control grid-to-anode gap;

a cylindrical dielectric member that supports said planar anode and contains said ionizable gas; and an annular shield member which extends from said anode into said control grid-to-anode gap to shield said dielectric member from sputtering impurities.

* * * * *